United States Patent [19]

Zell

[11] 4,173,387

[45] Nov. 6, 1979

[54] SNAP-ON PIN HEADER

[75] Inventor: Dale R. Zell, Elizabethtown, Pa.

[73] Assignee: AMP Incorporated, Harrisburg, Pa.

[21] Appl. No.: 890,887

[22] Filed: Mar. 28, 1978

[51] Int. Cl.[2] ..... H01R 13/02

[52] U.S. Cl. ..... 339/196 M

[58] Field of Search ..... 339/196 R, 206 R, 207 R, 339/210 R, 91 R, 91 L, 91 F, 91 B, 196 A, 196 M, 206 P, 206 L, 207 S, 210 M, 210 T, 156 R

[56] References Cited

U.S. PATENT DOCUMENTS

| | | | |
|---|---|---|---|
| 3,394,337 | 7/1968 | Miller | 339/91 R |
| 3,500,288 | 3/1970 | Startin et al. | 339/91 R |
| 3,568,001 | 3/1971 | Straus | 339/17 |
| 3,950,060 | 4/1976 | Stipanuk | 339/91 R |
| 4,053,199 | 10/1977 | Hollyday et al. | 339/91 R X |
| 4,068,915 | 1/1978 | Evans | 339/176 MP |

*Primary Examiner*—Joseph H. McGlynn
*Assistant Examiner*—John S. Brown
*Attorney, Agent, or Firm*—Russell J. Egan

[57] ABSTRACT

A pin header assembly is disclosed for snap-on mounting in a printed circuit board to provide a shrouded protection for a pin array extending from either or both sides of the board. The header not only provides a protective shroud for the pins but can be profiled to perform a polarizing and retention function as well as have stand-offs to allow for wire wrap of portions of the pins immediately adjacent one side of the board and yet provide full protection for the free ends of the pins.

8 Claims, 2 Drawing Figures

52
54
14
32
58
10
22
56
56
32
28
30
20
16
26
24
30
28
70
66
64
66
68
48
50
44
46
42
48
44
50
38
46
38
40
56
56
12

SNAP-ON PIN HEADER

BACKGROUND OF THE INVENTION

1. The Field Of The Invention

The present invention relates to a header providing a protective housing around a pin array in a printed circuit board and in particular to a header that can be used to provide protection on one or both sides of the printed circuit board with a stand-off on one of the sides.

2. The Prior Art

It is well known in the electrical connector industry to provide an array of fixed pins in a printed circuit board. These pins are usually gang inserted or sequentially inserted in a first step of a manufacturing operation to utilize the circuit board. No difficulty arises in the insertion of the pins but the subsequent handling of the boards during the steps of manufacturing can cause substantial problems. Frequently the boards, with a pin array already fixed therein, are simply thrown into a stack for subsequent handling. During this rough treatment it is not an unusual occurrance to have one or more of the pins bent to a misaligned condition. It has heretofore been the common practice to have the operators visually realign the pins with such tools that are available, such as merely a pair of needle nose pliers. Such handling frequently has a delitorious effect in that the operator's untrained eye cannot accurately align the pins plus the rather crude tools can damage and/or remove plating from the pins.

SUMMARY OF THE INVENTION

The subject snap-on pin header assembly comprises a pair of housing members which can be used individually or in conjunction to form shrouds about a pin array fixedly mounted in a printed circuit board or the like. The first shroud or housing member preferably has a substantially rectangular profile with an elongated profiled cavity opening in one side thereof. At opposite ends of the housing member are a pair of mounting leg means, each formed by a pair of legs with an outwardly directed detent on the free ends of each leg and an axial through bore between the legs. The second housing member has a like outer profile with a like elongated profiled cavity opening therein and a pair of mounting leg means at the opposite ends thereof. The leg means of the second member are quite similar to those of the first member except that they are of greater length and are dimensioned to fit through the axial bores of the first leg means. Thus the second member will effectively be held in a stand-off position from a second side of a printed circuit board while the first member rests against the board.

It is therefore an object of the present invention to provide a snap-on pin header assembly which can be used to protect an array of pins fixedly mounted in a printed circuit board during subsequent processing of the circuit board.

It is another object of the present invention to produce a pin header assembly which can be snapped onto a printed circuit board to protect a pin array, which is fixedly mounted in a circuit board, from either or both sides of the board.

It is yet another object of the present invention to produce a snap-on pin header assembly which will protect the pins of a pin array mounted in a circuit board and will provide a polarized mating of a connector with the pins.

It is still another object of the present invention to produce a snap-on pin header assembly for protecting an array of pins mounted in a printed circuit board in which the header assembly will have a stand-off on one side of the board, to allow direct pin wire wrapping of the pins on that side of the board without interfering with the subsequent interconnection of a connector with the pins.

It is a further object of the present invention to produce a snap-on pin header assembly providing a retention feature for a connector plug mating with the shrouded pin array.

It is a still further object of the present invention to produce a snap-on pin header assembly which can be readily and economically manufactured.

The means for accomplishing the foregoing objects and other advantages of the present invention will be made clear to those skilled in the art from the following detailed description taken with reference to the accompanying drawings.

DETAILED DESCRIPTION OF THE INVENTION

Figure 1:
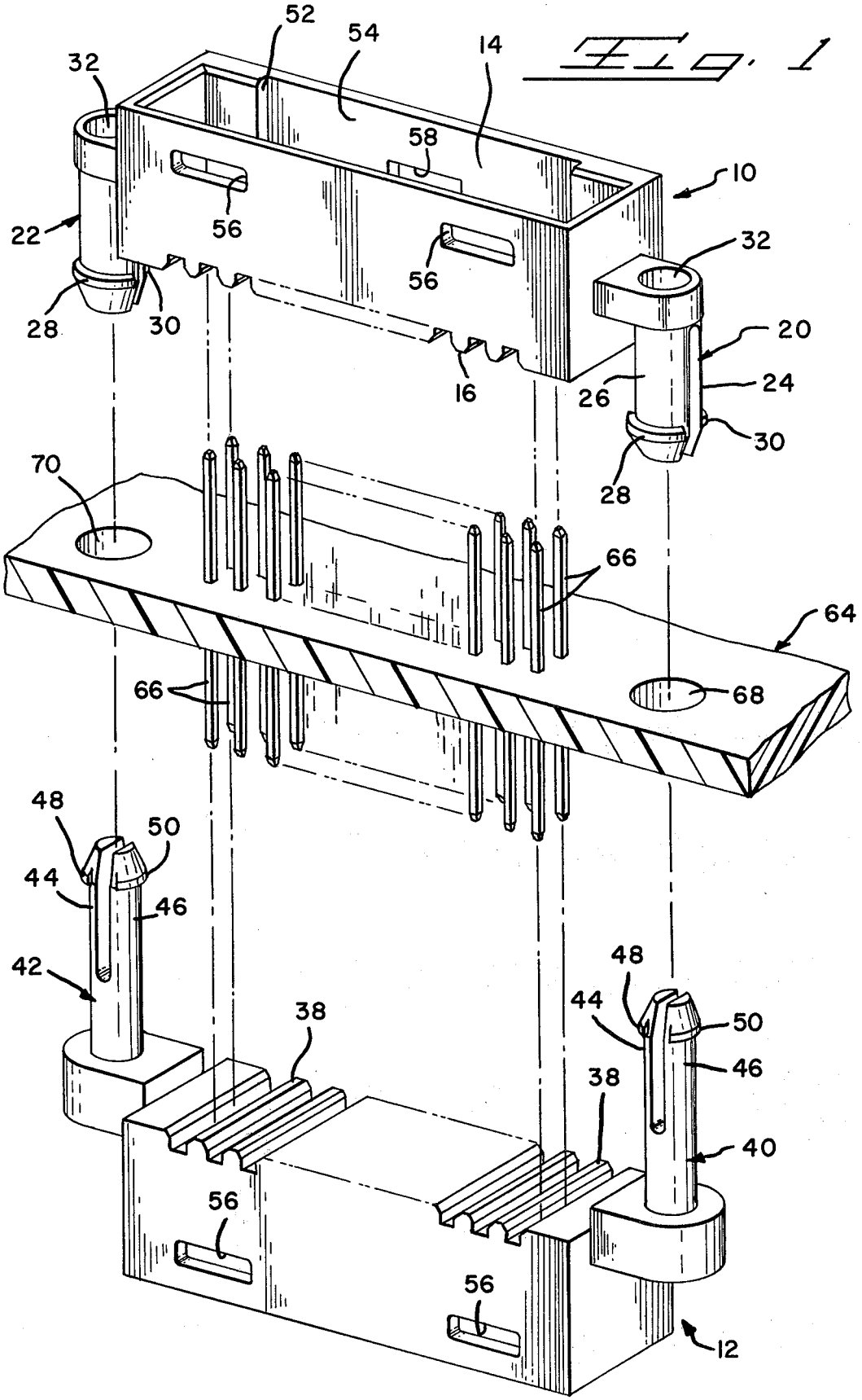
FIG. 1 is an exploded perspective view of the subject snap-on pin header.

The subject snap-on pin header assembly is comprised of first and second header members 10, 12, respectively. The header members are quite similar in appearance yet have several structural differences which will be described in detail hereinbelow. The first header member 10 is a substantially rectangular member having an elongated profiled cavity 14 opening in one surface thereof and an opposite base 16 having a plurality of pin passages 18 therein aligned to receive the respective pins of the array. At opposite ends of the member 10 are downwardly directed mounting leg means 20, 22. Each of the mounting leg means has an outer cylindrical profile and is comprised of a pair of integral, depending leg portions 24, 26, each with an outwardly directed arcuate detent shoulder 28, 30 adjacent the free end thereof, and an axial bore 32 passing through between the leg portions 24, 26. The second member 12 has a like outer profile with an elongated profiled cavity 34 opening in one face thereof. A like plurality of pin passages 36 are spaced about the bottom 38 of the second member, aligned to receive the respective pins of the array, and a pair of second mounting leg means 40, 42 are at the opposite ends thereof. Each of the second leg means has a cylindrical outer profile and is made up of a pair of leg portions 44, 46 each having an outwardly directed arcuate shoulder 48, 50 on the free ends thereof. The legs 44, 46 are dimensioned to be received through the axial bore 32 of the leg means 20, 22.

As mentioned above, the header members 10 and 12 have profiled cavities 14, 34, respectively. The profiles of the cavities include polarizing and/or keying projections 52 and recesses 54 as well as apertures 56, 58 spaced from the mating face to receive therein retention lugs 60 on mating plug members 62.

Figure 2:
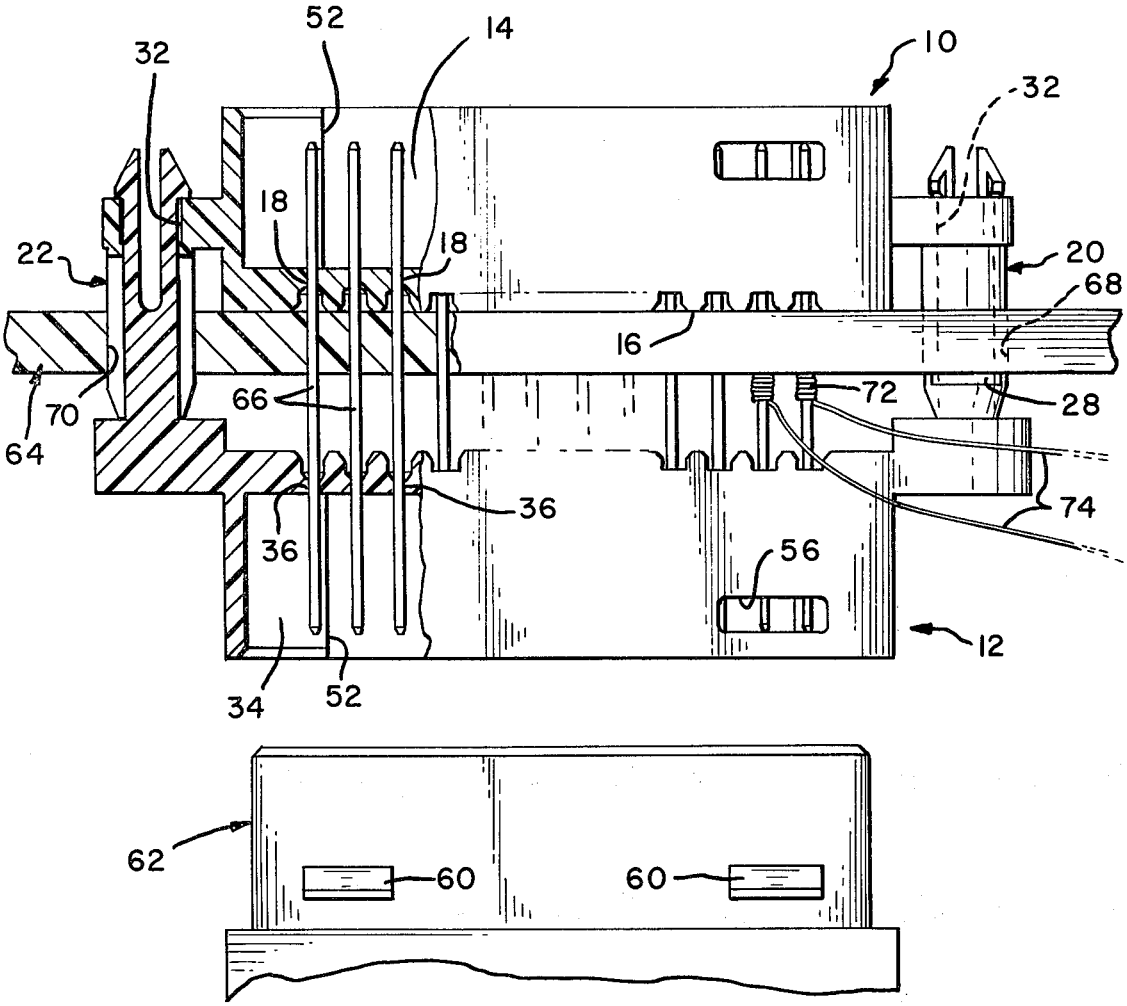
FIG. 2 is a side elevation, partly in section, of the subject pin header mounted on a printed circuit board with a mating connector exploded from one side.

The subject header assembly is mounted on a printed circuit board 64 that is provided with an array of pins 66 fixedly mounted therein and a pair of spaced apertures 68, 70 aligned with opposite ends of the pin array. The first header member 10 is mounted on the board with the pins 66 being received in the appropriate apertures 18 and the leg means 20, 22 being snap fitted into the respective apertures 68, 70. It will be noted that from FIG. 2 that the first header 10 lies in intimate contact with a first surface of the printed circuit board. It should be clear that, if desired, this portion of the header assembly can be used alone. The second pin header 12 is assembled from the opposite side of the printed circuit board with the leg means 40, 42 being inserted through the respective bores 30 of the legs 20, 22. It will be noted from FIG. 2 that, because of the shoulders 28, 30 of the first leg means 20, 22 and the length of the second leg means 40, 42, the second header 12 will be held in a stand-off position spaced from a second side of the printed circuit board. This will allow access to the pins to effect a wire wrap interconnection 72 of conductors 74 with the respective pins 66, if such is desired.

It should also be noted that the flexure slots of the leg means of the two headers extend at right angles to one another. This serves as an anti-tangle arrangement to prevent fouling of the leg portions.

The present invention may be subject to many modifications and changes without departing from the spirit or essential characteristics thereof. The present embodiment should therefore be considered in all respects as illustrative and not restrictive of the scope of the invention.

What is claimed is:

1. A snap-on header assembly comprising:

first and second header members each having a substantially rectangular profile defining a connector receiving cavity therein, a base of each said cavity having a plurality of pin apertures therein aligned to receive a like plurality of pins therethrough, and mounting leg means at each end of said members, the mounting leg means of said first connector member each being defined by a pair of spaced, integral, depending leg portions having an outer arcuate profile and an inner axial bore therebetween, and an outwardly directed arcuate shoulder on the free end of each of said leg portions; and the mounting leg means of said second member each being defined by a pair of leg portions together having an outer cylindrical profile with a slot between said leg portions and outwardly directed shoulders on the free ends thereof, said leg means of said second member being dimensioned to be received through said bores of said first leg means with the shoulders engaging on the far side thereof.

2. The snap-on pin header assembly according to claim 1 wherein at least one of said cavities is profiled to provide polarized interconnection with a mating connector member.

3. The snap-on pin header assembly according to claim 1 wherein at least one of said cavities includes an aperture in a sidewall adapted to receive therein a retention lug of a mating connector member.

4. A snap-on pin header for protecting an array of pins fixedly mounted in a printed circuit board or the like, said header comprising:

a header member of rigid insulation material having an elongated outer profile defining a profiled connector receiving cavity therein, a base of said cavity having a plurality of pin apertures therein aligned to receive a like plurality of pins therethrough, and integral mounting leg means depending from said member, each said mounting leg means being defined by a bifurcated extension having resilient latching portions on the free ends for receipt in apertures in the circuit board and a longitudinally extending socket adapted to receive a mounting leg of another similar header mounted from the other side of said circuit board, whereby said header member is mounted on a printed circuit board by engagement of said leg means in respective apertures in said board with the pins of the array received through said apertures and extending into said cavity to be protected by said header.

5. A snap-on pin header according to claim 4 further comprising:

a second header member of rigid insulation material having an elongated outer profile defining a profiled connector receiving cavity therein, a base of said cavity having a plurality of pin apertures therein aligned to receive a like plurality of pins therethrough, and mounting leg means at each end of said member, said mounting leg means each being defined by a bifurcated extension having resilient latching portions on the free ends adapted to be received in said longitudinal sockets of the leg portions of said first header, whereby said second header member is mounted on a printed circuit board on the side opposite the first header member by said second leg means being received through the sockets of said first leg means.

6. A snap-on pin header according to claim 5 wherein each said profiled cavity includes polarizing projections and recesses.

7. A snap-on header according to claim 5 wherein each said header includes apertures adapted to receive therein retention lugs of mating connector members.

8. A snap-on pin header according to claim 5 wherein said second header member is held spaced from said second side of the printed circuit board by said first leg means.

* * * * *

UNITED STATES PATENT AND TRADEMARK OFFICE

Certificate

Patent No. 4,173,387 Patented November 6, 1979

Dale Richard Zell

Application having been made by Dale Richard Zell, the inventor named in the patent above identified, and AMP Incorporated, Harrisburg, Pa., the assignee, for the issuance of a certificate under the provisions of Title 35, Section 256, of the United States Code, adding the name of Burrell Howard Barry as a joint inventor, and a showing and proof of facts satisfying the requirements of the said section having been submitted, it is this 29th day of July 1980, certified that the name of the said Burrell Howard Barry is hereby added to the said patent as a joint inventor with the said Dale Richard Zell.

FRED W. SHERLING,
*Associate Solicitor.*